US011486342B2

(12) United States Patent
Kim et al.

(10) Patent No.: US 11,486,342 B2
(45) Date of Patent: Nov. 1, 2022

(54) APPARATUS FOR AMPLIFYING SOUND WAVES

(71) Applicants: Hyundai Motor Company, Seoul (KR); Kia Motors Corporation, Seoul (KR)

(72) Inventors: Je Yeon Kim, Yangsan-Si (KR); Hae Jun Jeong, Hwaseong-Si (KR); Yoon Geun Cho, Daegu (KR); Seung Hyun Lee, Icheon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 174 days.

(21) Appl. No.: 17/089,079

(22) Filed: Nov. 4, 2020

(65) Prior Publication Data

US 2021/0363948 A1 Nov. 25, 2021

(30) Foreign Application Priority Data

May 25, 2020 (KR) ..... 10-2020-0062172

(51) Int. Cl.
*F02M 35/12* (2006.01)
*G10K 11/08* (2006.01)

(52) U.S. Cl.
CPC ..... *F02M 35/1294* (2013.01); *G10K 11/08* (2013.01)

(58) Field of Classification Search
CPC ..... F02M 35/1294; F02M 35/12; F02M 35/1222; G10K 11/08
See application file for complete search history.

(56) References Cited

U.S. PATENT DOCUMENTS 6,932,189 B2 * 8/2005 Helber ..... F01N 13/00 181/219
7,188,703 B2 * 3/2007 Hofmann ..... G10K 11/22 181/204
7,353,791 B2 * 4/2008 Sasaki ..... F02M 35/10019 123/184.56
7,506,626 B2 * 3/2009 Sasaki ..... F02M 35/1294 123/184.53
7,621,370 B2 * 11/2009 Abe ..... F02M 35/161 181/204
7,975,802 B2 * 7/2011 Yokoya ..... F02M 35/10295 181/271

(Continued)

FOREIGN PATENT DOCUMENTS

CN 110017226 A * 7/2019 ..... F02M 35/02
KR 101405222 6/2014
KR 20160008280 A * 1/2016 ..... G01N 29/24

*Primary Examiner* — Edgardo San Martin
(74) *Attorney, Agent, or Firm* — Morgan, Lewis & Bockius LLP

(57) ABSTRACT

An apparatus of amplifying sound waves may include a metamaterial structure having a metamaterial inside thereof, an inlet through which air flows into the metamaterial structure, and a penetration portion formed to penetrate a portion of one side of the metamaterial structure, a membrane member coupled to the penetration portion, and a resonance member surrounding the membrane member and coupled to the metamaterial structure and including a space inside thereof and a discharge port fluidically communicating with an outside thereof and the internal space.

15 Claims, 7 Drawing Sheets

(56) References Cited

U.S. PATENT DOCUMENTS

| | | | | |
|---|---|---|---|---|
| 8,011,469 | B2 * | 9/2011 | Olson | F02M 35/1272 181/204 |
| 8,322,486 | B2 * | 12/2012 | Ohta | F02M 35/1294 123/184.57 |
| 9,429,117 | B2 * | 8/2016 | Takahashi | F02M 35/1294 |
| 9,909,545 | B1 * | 3/2018 | Waisanen | B63H 20/32 |
| 9,959,855 | B2 * | 5/2018 | Song | G10K 11/08 |
| 10,616,679 | B2 * | 4/2020 | Mathur | H04R 1/2834 |
| 10,701,478 | B1 * | 6/2020 | Mathur | H04R 1/025 |
| 10,746,078 | B2 * | 8/2020 | Kim | F01N 13/001 |

* cited by examiner

APPARATUS FOR AMPLIFYING SOUND WAVES

CROSS-REFERENCE TO RELATED APPLICATION

The present application claims priority to Korean Patent Application No. 10-2020-0062172 filed on May 25, 2020, the entire contents of which is incorporated herein for all purposes by this reference.

BACKGROUND OF THE INVENTION

Field of the Invention

The present invention relates to an apparatus of amplifying sound waves, and more particularly, to an apparatus of amplifying sound waves including a metamaterial.

Description of Related Art

Owing to development of eco-friendly technologies together with strengthening of environmental laws and regulations around the world, engine downsizing is being done in most internal combustion engine vehicles. To compensate for the decrease in engine power due to such engine downsizing, a turbocharger is often applied to sports concept vehicles.

With a turbocharger, engine power may be improved, but natural engine sound may be weakened, which is undesirable especially for a sports car. This is because an engine with a turbocharger has a longer sound transmission path to the outside than an engine without a turbocharger. As the engine sound is an important characteristic of sports cars, measures to solve the present problem are required.

As such measures, various techniques, such as an electric sound generator (ESG), a virtual engine sound system (VESS), etc., are emerging at present. An existing active sound generator controls a tone by varying the discharge port of a noise generator using a controller depending on an engine RPM, vehicle load conditions, etc. This active sound generator includes a motor, the controller, a flap, a membrane, a cover, a hose, a coupling clamp, etc., requires a large number of portions due to its complicated shape, and incurs high production costs resulting from the use of the motor and the controller. Furthermore, the conventional active sound generator requires additional power to operate the motor, increasing the amount of power consumed by the vehicle and an additional cable is required. Moreover, many drivers are not satisfied with the present virtual sound since the produced virtual sound is not the actual engine sound.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing an apparatus of amplifying sound waves, which satisfies both the natural engine sound and environmental friendliness.

Various aspects of the present invention are directed to providing an apparatus of amplifying sound waves, which amplifies an actual engine sound without applying separate power.

It is yet another object of the present invention to provide an apparatus of amplifying sound waves, which provides an actual engine sound even in a vehicle with a turbocharger.

It is yet another object of the present invention to provide an apparatus of amplifying sound waves, which can reduce overall costs and reduce the number of parts.

Various aspects of the present invention are directed to providing an apparatus of amplifying sound waves including a metamaterial structure including a metamaterial inside thereof, an inlet through which air flows into the metamaterial structure, and a penetration portion formed to penetrate a portion of one side of the metamaterial structure, a membrane member coupled to the penetration portion, and a resonance member surrounding the membrane member and coupled to the metamaterial structure and including a space and a discharge port configured to communicate with an outside.

In various exemplary embodiments of the present invention, the apparatus may further include a hermetic seal maintaining airtightness of a circumference of the membrane member.

In various exemplary embodiments of the present invention, the metamaterial may include a plurality of passages repeatedly formed, and the passages are in communicate with the inlet and the membrane member.

In various exemplary embodiments of the present invention, each of the passages may be formed in a zig-zag shape.

In various exemplary embodiments of the present invention, each of the passages may include a first flow path extending in a direction aligned with an inflow direction of air, a second flow path extending from an end of the first flow path leftward or rightward with respect to the first flow path, a third flow path being in fluidical communication with the second flow path, extending from an end of the second flow path in an extending direction of the first flow path, and being parallel to the first flow path, and a fourth flow path being in fluidic communication with the third flow path, extending from an end of the third flow path toward the extending direction of the first flow path parallel to the second flow path.

In various exemplary embodiments of the present invention, a section of hollow space may be formed inside the metamaterial structure, and the penetration portion contacts with the section.

In various exemplary embodiments of the present invention, the metamaterial may include a plurality of passages repeatedly formed, and the air flowing into the metamaterial structure through the inlet may sequentially pass through the passages and the section and flow into the resonance member via the membrane member.

In various exemplary embodiments of the present invention, the metamaterial structure may further include a first housing receiving the metamaterial inside, and a second housing airtightly coupled to the first housing and provided with the penetration portion.

In various exemplary embodiments of the present invention, the first housing may include a partition member protruding from a portion of a circumference of the first housing, a second housing may include a protrusion protruding from one side of the second housing and coupled to the partition member, and the inlet is defined by a space formed by coupling the partition member and the protrusion to each other.

In various exemplary embodiments of the present invention, a sealing member may be mounted around a circumference of the inlet to ensure airtightness.

In various exemplary embodiments of the present invention, the apparatus may further include a plurality of through holes piercing the first housing and the second housing, and fastening members fixedly inserted into the through holes.

In various exemplary embodiments of the present invention, an insert protruding from a surface of the second housing and being spaced from a circumference of the penetration portion by a certain distance, and the resonance member may be tightly coupled to the insert.

Other aspects and exemplary embodiments of the present invention are discussed infra.

The above and other features of the present invention are discussed infra.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
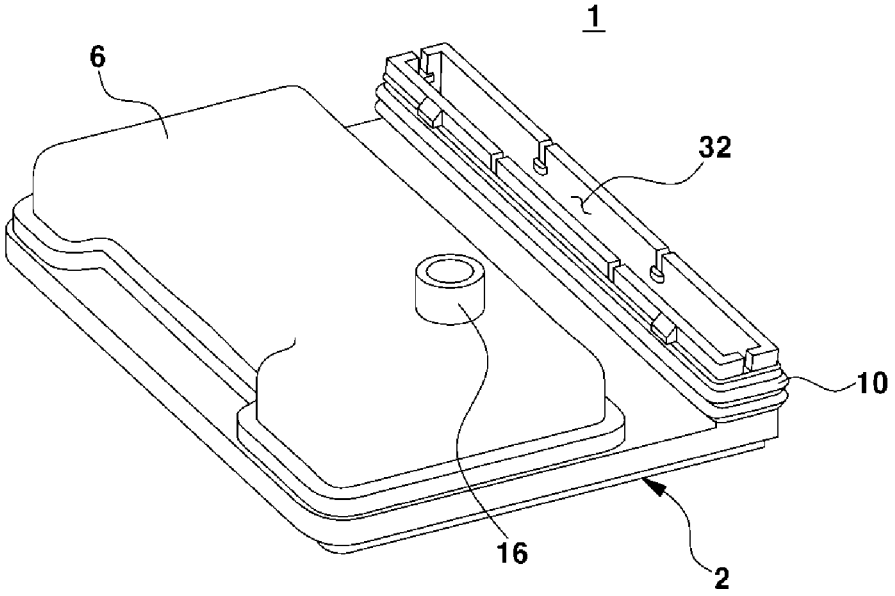
FIG. 1 is a perspective view exemplarily illustrating an apparatus of amplifying sound waves according to various exemplary embodiments of the present invention.

It may be understood that the appended drawings are not necessarily to scale, presenting a somewhat simplified representation of various exemplary features illustrative of the basic principles of the present invention. The specific design features of the present invention as included herein, including, for example, specific dimensions, orientations, locations, and shapes, will be determined in part by the particular intended application and use environment.

In the figures, reference numbers refer to the same or equivalent parts of the present invention throughout the several figures of the drawings.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

In the following description of the embodiments, terms, such as "first" and "second", may be used to describe various elements but do not limit the elements. These terms are used only to distinguish one element from other elements. For example, a first element may be named a second element and similarly a second element may be named a first element, without departing from the scope and spirit of the present invention.

When an element or layer is referred to as being "on," "engaged with," "connected to," or "coupled to" another element or layer, it may be directly on, engaged with, connected or coupled to the other element or layer, or intervening elements or layers may be present. In contrast, when an element is referred to as being "directly on," "directly engaged with," "directly connected to," or "directly coupled to" another element or layer, there may be no intervening elements or layers present. Other words used to describe the relationship between elements, e.g., "between" versus "directly between," "adjacent" versus "directly adjacent," etc., may be interpreted in a like fashion.

In the following description of the embodiments, the same elements are denoted by the same reference numerals even though they are depicted in different drawings. The terminology used herein is for describing particular example embodiments only and is not intended to be limiting. In the following description of the embodiments, singular expressions may encompass plural expressions, unless they have clearly different contextual meanings. In the following description of the embodiments, terms, such as "comprising", "including", "having", etc., will be interpreted as indicating the presence of characteristics, numbers, steps, operations, elements or parts stated in the description or combinations thereof, and do not exclude the presence of one or more other characteristics, numbers, steps, operations, elements, parts or combinations thereof, or possibility of adding the same.

An apparatus of amplifying sound waves according to various exemplary embodiments of the present invention includes a metamaterial structure including a metamaterial inside thereof, an inlet through which air flows into the metamaterial structure, and a penetration portion formed in a portion of one side of the metamaterial structure, a membrane member coupled to the penetration portion, and a resonance member surrounding the membrane member and coupled to the metamaterial structure and including a space inside thereof and a discharge port fluidically communicating with an outside thereof and the internal space.

The apparatus of amplifying sound waves according to various exemplary embodiments of the present invention has excellent sound wave amplification performance.

The apparatus of amplifying sound waves according to various exemplary embodiments of the present invention can amplify and transmit an actual engine sound rather than a virtual engine sound.

The apparatus of amplifying sound waves according to various exemplary embodiments of the present invention can reduce overall costs and the number of parts and have a simple structure.

Hereinafter, various exemplary embodiments of the present invention will be illustrated with reference to the accompanying drawings.

Figure 2:
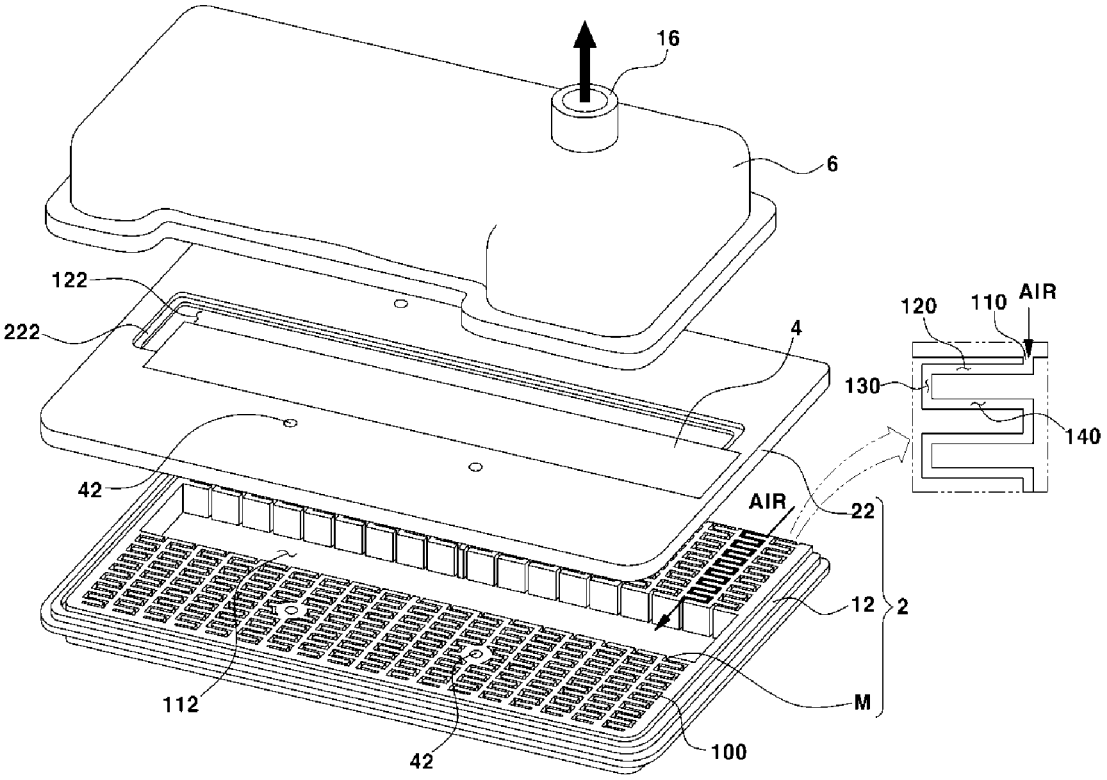
FIG. 2 is an exploded perspective view of the apparatus of amplifying sound waves according to various exemplary embodiments of the present invention, in a state in which an intake system-mounted side of the apparatus is omitted.

FIG. 1 is a perspective view exemplarily illustrating an apparatus 1 for amplifying sound waves according to various exemplary embodiments of the present invention, and FIG. 2 is an exploded perspective view of FIG. 1, in a state in which some elements of an intake system-mounted side of the apparatus 1 for amplifying sound waves are omitted.

As shown in FIG. 1 and FIG. 2, the apparatus 1 for amplifying sound waves according to various exemplary embodiments of the present invention includes a metamaterial structure 2, a membrane member 4 and a resonance member 6.

The metamaterial structure 2 includes a metamaterial M inside, and the metamaterial M amplifies sound waves in the metamaterial structure 2. The metamaterial M is any material which is engineered to have a property which is not found in naturally occurring materials. The metamaterial M is made from assemblies of a plurality of elements fashioned from composite materials such as metals and plastics and usually repeatedly mounted.

To physically reduce the propagation speed of sound waves and concentrate acoustic pressure on the interior of a small space, acoustic properties of high refractive index and high impedance are required. However, the speed of sound waves increases as the density of the material increases in most natural materials. Thus, these materials cannot achieve both high refractive index and high impedance. The metamaterial M according to various exemplary embodiments of the present invention possesses a zig-zag structure that can reduce the speed of sound waves in a medium such that the metamaterial attains a high refractive index characteristic. Also, the metamaterial M provides a high impedance characteristic where acoustic pressure increases by generation of resonance at a specific frequency. Hence, the metamaterial has properties that cannot be found in the natural world. Here, various principles may be used to generate resonance. For example, resonance may be generated using the principle of a Helmholtz resonator in the same manner as a regular resonator, or Febry-Perot resonance in which resonance is generated by overlapping reflected waves and transmitted waves of sound waves between two media may be used.

Although the metamaterial M according to various exemplary embodiments of the present invention is not limited to a specific shape, the metamaterial M has a repeated pattern. A plurality of passages 100 directed to a penetration portion 122 or a section 112 may be formed regardless of the shape of the metamaterial M. Each of the plurality of passages 100 is configured to fluidically communicate with an inlet 32 and the membrane member 4.

According to an implementation of the present invention, each of the passages 100 is formed in a zig-zag shape. According to an implementation of the present invention, each of the passages 100 may include a first flow path 110, a second flow path 120, a third flow path 130 and a fourth flow path 140. Furthermore, each of the passages 100 may include a plurality of first flow paths 110, second flow paths 120, third flow paths 130 and fourth flow paths 140 which are disposed repeatedly.

According to an implementation of the present invention, the first to fourth flow paths 110, 120, 130 and 140 are formed to communicate with each other. The first flow path 110 extends in a direction aligned with the inflow direction of air. That is, the first flow path 110 extends in a direction aligned with the direction of air flowing into the metamaterial M in the metamaterial structure 2. The second flow path 120 extends from the first flow path 110 in a leftward direction or a rightward direction with respect to the first flow path 110. That is to say, the second flow path 120 changes the extending direction of the first flow path 110 and extends in the leftward direction or the rightward direction thereof. The third flow path 130 fluidically communicates with the second flow path and extends in the same direction as the extending direction of the first flow path 110 parallel to the first flow path. The third flow path 130 extends in a direction parallel to the first flow path 110, and the first flow path 110 and the third flow path are spaced from each other by about the length of the second flow path 120. The fourth flow path 140 fluidically communicates with the third flow path 130 and extends in a direction toward the first flow path 110 parallel to the second flow path 120. That is, the fourth flow path 140 extends in parallel to the second flow path 120 and is spaced from the second flow path 120 by about the length of the third flow path 130.

Figure 3:
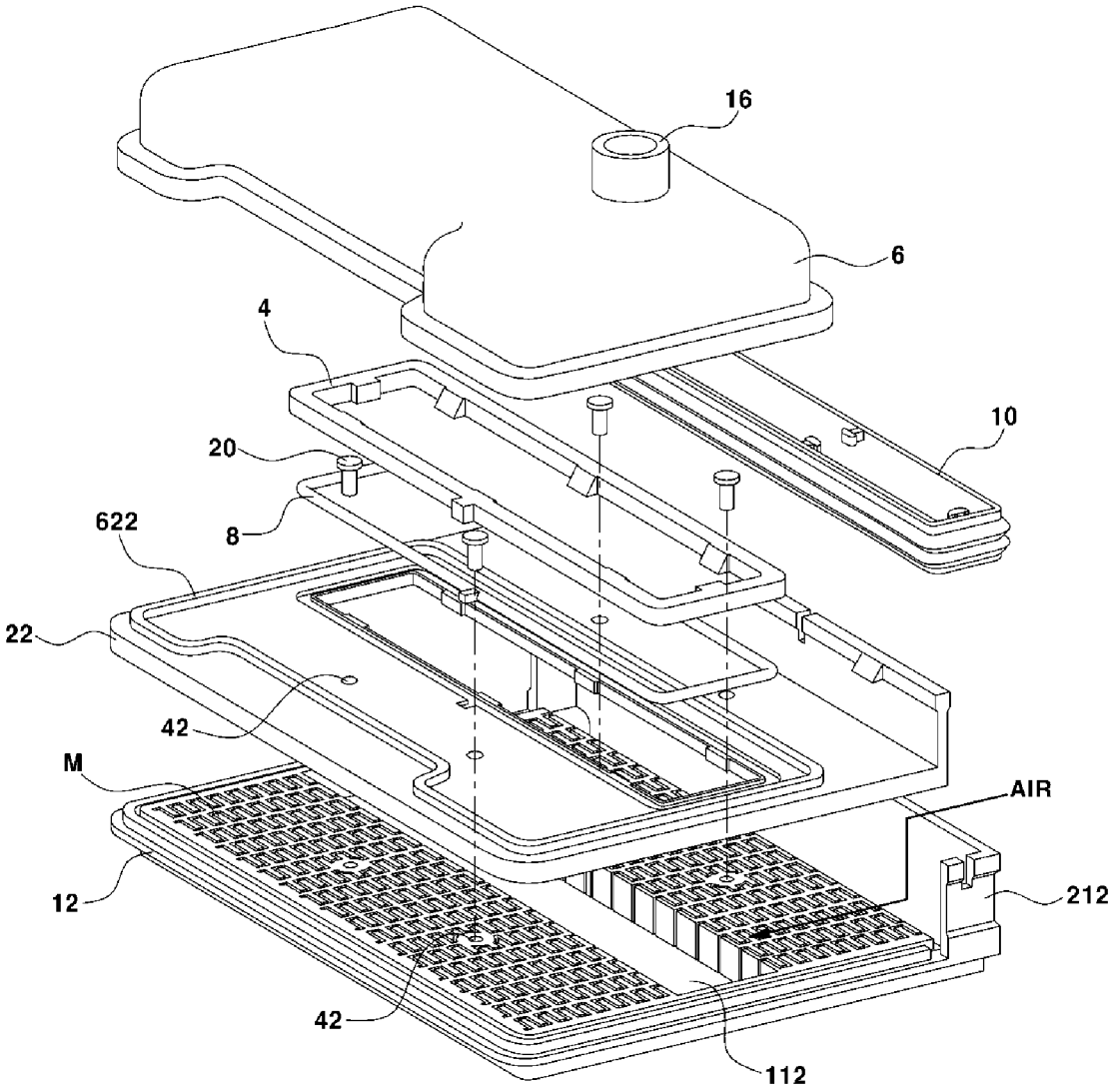
FIG. 3 is an exploded perspective view of FIG. 1.

FIG. 3 is an exploded perspective view of the apparatus of amplifying sound waves according to various exemplary embodiments of the present invention shown in FIG. 1.

As shown in FIG. 3, the metamaterial structure 2 includes a housing unit 12 and 22, and the metamaterial M is received in the housing unit 12 and 22. The housing unit 12 and 22 is configured as a casing for the metamaterial M and is configured to maintain airtightness of the interior of the housing unit 12 and 22 other than the penetration portion 122 for radiating sound waves. The housing unit 12 and 22 may include a first housing 12, a second housing 22 and the inlet 32. Although the housing unit 12 and 22 according to various exemplary embodiments of the present invention is referred to as including two housings, i.e., the first housing 12 and the second housing 22, which are separately provided, the first housing 12 and the second housing 22 may be formed integrally as a single unit.

Airtightness between the first housing 12 and the second housing 22 is maintained in regions other than the inlet 32 and the penetration portion 122 which are configured such that air flows thereinto.

The first housing 12 receives the metamaterial M inside. The section 112 with an empty space where no metamaterial M is provided may be formed in the first housing 12.

A partition member 212 protrudes from a perimeter of the first housing 12. According to an implementation of the present invention, the partition member 212 is formed in a portion of the circumference of the first housing 12.

Figure 4:
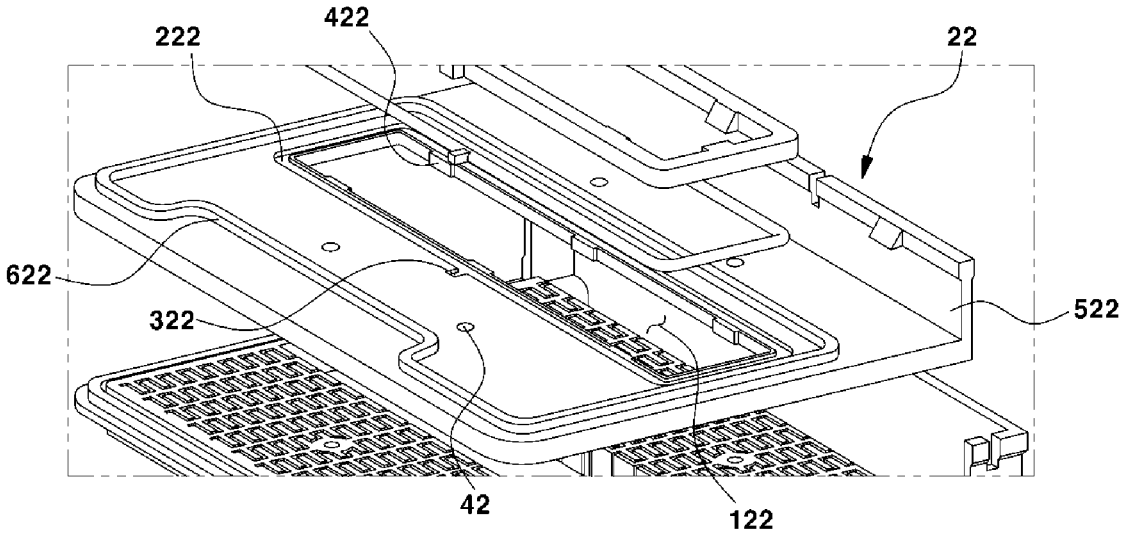
FIG. 4 is a partially enlarged view of a second housing of the apparatus of amplifying sound waves according to various exemplary embodiments of the present invention.

The second housing 22 is coupled to the first housing 12. Coupling portions between the first housing 12 and the second housing 22 is kept airtight. For the present purpose, the first housing 12 and the second housing 22 may be configured to maintain airtightness therebetween through welding. Furthermore, airtightness may be enhanced by one or more fastening members 20 that are attached to through-holes 42, as described below. FIG. 4 depicts a partially enlarged view exemplarily illustrating the second housing 22.

Referring to FIG. 4, the penetration portion 122 is formed through the second housing 22. The penetration portion 122 is in fluidic communication with the interior of the first housing 12 and in fluidic communication with the section 112 in the first housing 12.

A receiving groove 222 may be formed at the perimeter of the penetration portion 122. According to an implementation of the present invention, the receiving groove 222 is recessed from the surface of the second housing 22. Furthermore, a guide groove 322 may be formed in one side of the penetration portion 122 to guide insertion of the membrane member 4. The guide groove 322 may extend outwardly from the receiving groove 22. Moreover, a plurality of coupling protrusions 422 may be formed on the perimeter surrounding the penetration portion 122 to guide insertion of the membrane member 4.

According to an implementation of the present invention, a protrusion 522 protrudes from the surface of the second housing 22 at one side of the second housing 22. The protrusion 522 is coupled to the partition member 212 of the first housing 12, which defines the inlet 32 for air received from an intake system.

According to various exemplary embodiments of the present invention, an insert 622 protrudes from the surface of the second housing 22. The insert 622 may be spaced a certain distance apart from the perimeter of the penetration portion 122.

According to various exemplary embodiments of the present invention, a plurality of through-holes 42 are formed through the first housing 12 and the second housing 22. The fastening members 20 may be inserted into the through-holes 42, providing additional coupling force for maintaining airtightness.

The perimeter of the inlet 32 defined by coupling the first housing 12 and the second housing 22 to each other is kept hermetically sealed. All portions of the inlet 32 are kept hermetically sealed, except for a portion coupled to the intake system and the passage to the metamaterial M. According to one implementation of the present invention, a sealing member 10 is mounted on the perimeter of the inlet 32 to maintain airtightness. The sealing member 10 mounted on the perimeter of the inlet 32 defined by the partition member 212 and the protrusion 522 ensures airtightness. If airtightness is not maintained when an intake system is connected to the apparatus 1 for amplifying sound waves, problems, such as noise, may occur. According to various exemplary embodiments of the present invention, airtightness may be ensured by the inlet 32, formed by coupling the first housing 12 and the second housing 22 to each other and the sealing member 10 mounted on the inlet 32.

The apparatus 1 for amplifying sound waves according to various exemplary embodiments of the present invention includes the membrane member 4. The membrane member 4 is designed to transmit vibrations of the metamaterial structure 2 to the resonance member 6 through a thin film. According to an implementation of the present invention, the membrane member 4 may be accommodated on the penetration portion 122 of the second housing 22 and in the receiving groove 222 of the second housing 22. The membrane member 4 is sealingly coupled to the penetration portion 122.

Figure 5:
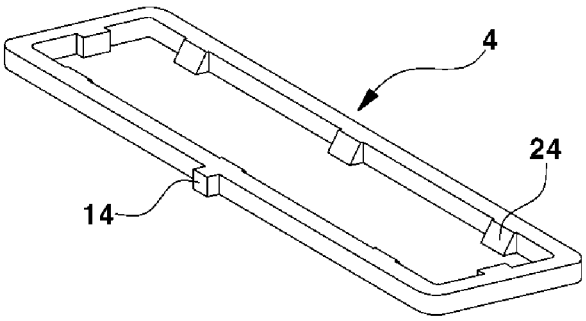
FIG. 5 is a perspective view exemplarily illustrating a membrane member of the apparatus of amplifying sound waves according to various exemplary embodiments of the present invention.

FIG. 5 is a perspective view of the membrane member.

As shown in FIG. 5, according to one implementation of the present invention, the membrane member 4 includes a guide protrusion 14 and coupling grooves 24 to ensure firm coupling and to guide coupling of the membrane member 4 to the second housing 22. The guide protrusion 14 may be configured to be accommodated in the guide groove 322 of the second housing 22, and the coupling grooves 24 may be configured to be engaged with the coupling protrusions 422 of the second housing 22.

An airtight member 8 is mounted around the membrane member 4. The airtight member 8 is provided to hermetically seal the perimeter of the membrane member 4.

According to one implementation of the present invention, the airtight member 8 may be accommodated in the receiving groove 222. The membrane member 4 may be tightly mounted on the airtight member 8 accommodated in the receiving groove 222 of the second housing 22 for better. When the membrane member 4 is mounted on a portion of the side of the housing unit 12 and 22 where sound waves are amplified, the coupling portion between the portion of the side of the housing unit 12 and 22 and the membrane member 4 may be kept airtight. Unless this is the case, the sound waves cannot be amplified through the membrane member 4. According the present invention, the coupling portion between the portion of the side of the housing unit 12 and 22 and the membrane member 4 may be hermetically sealed by the sealing member 8. In addition to the sealing member 8, the housing unit 12 and 22 and the membrane member 4 may be integrally formed to improve airtightness.

As a non-limiting example, the airtight member 8 may be formed of rubber or plastic. The airtight member 8 may be formed of any material configured for ensuring airtightness.

The resonance member 6 is mounted on the second housing 22. The resonance member 6 is mounted on the second housing 22 to sealingly surround the membrane member 4. According to one implementation of the present invention, the resonance member 6 is sealingly attached to the insert 622 of the second housing 22.

A space is formed inside the resonance member 6, and a discharge port 16 communicating with the outside is formed on the resonance member 6. The volume of the resonance member 6 and the diameter and length of the discharge port 16 may be adjusted to be suitable for a target frequency which generates resonance by the resonance member 6 at the target frequency.

Figure 6A:
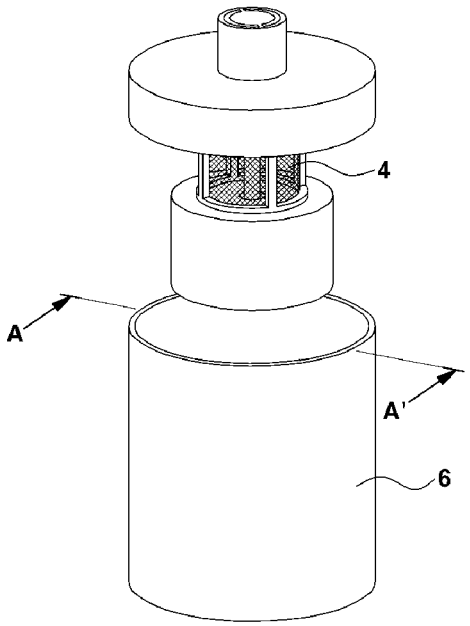
FIG. 6A is a perspective view of an apparatus of amplifying sound waves according to various exemplary embodiments of the present invention.
Figure 6B:
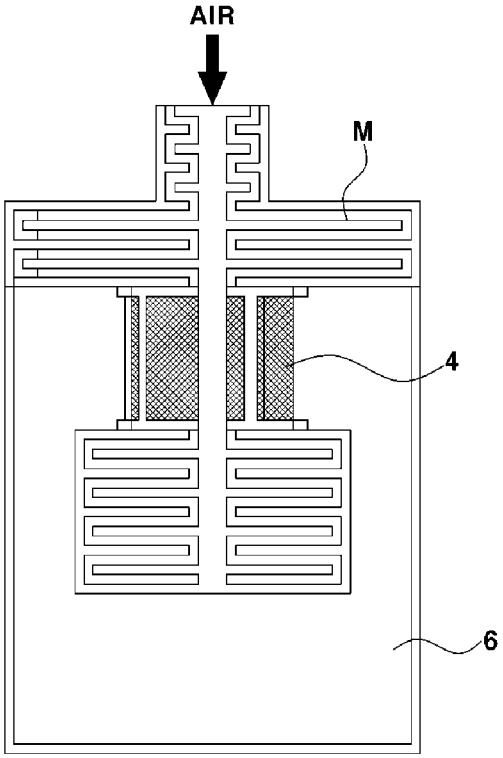
FIG. 6B is a cross-sectional view of FIG. 6A, taken along line A-A'.

The apparatus of amplifying sound waves according to various exemplary embodiments of the present invention may be implemented in any one of various embodiments other than the above-described embodiments. Accordingly, the apparatus of amplifying sound waves proves high versatility and usability. The apparatus of amplifying sound waves according to various exemplary embodiments of the present invention is applicable to any flow paths where air flows such as an air cleaner, an air hose, an air duct, etc. Also, it may be applied to a cylindrical structure, as shown in FIG. 6A and FIG. 6B.

The operation and effects of the apparatus 1 for amplifying sound waves according to various exemplary embodiments of the present invention will be referred to as follows.

Figure 7A:
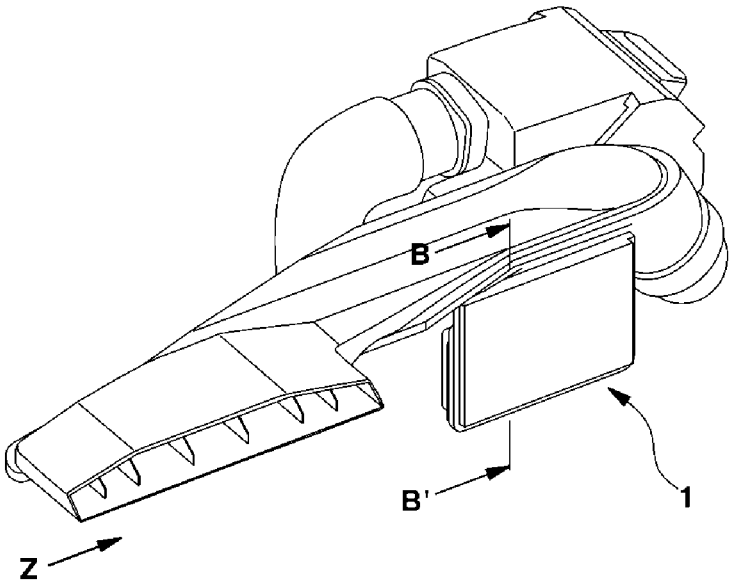
FIG. 7A is a view exemplarily illustrating a state in which the apparatus of amplifying sound waves according to various exemplary embodiments of the present invention is mounted on an intake system.
Figure 7B:
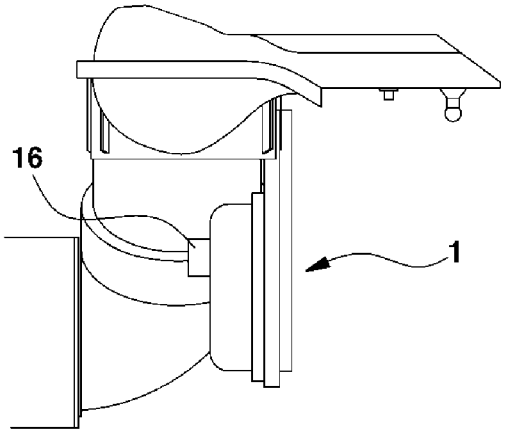
FIG. 7B is a view exemplarily illustrating the apparatus of amplifying sound waves according to various exemplary embodiments of the present invention, as seen in direction Z of FIG. 7A.
Figure 8:
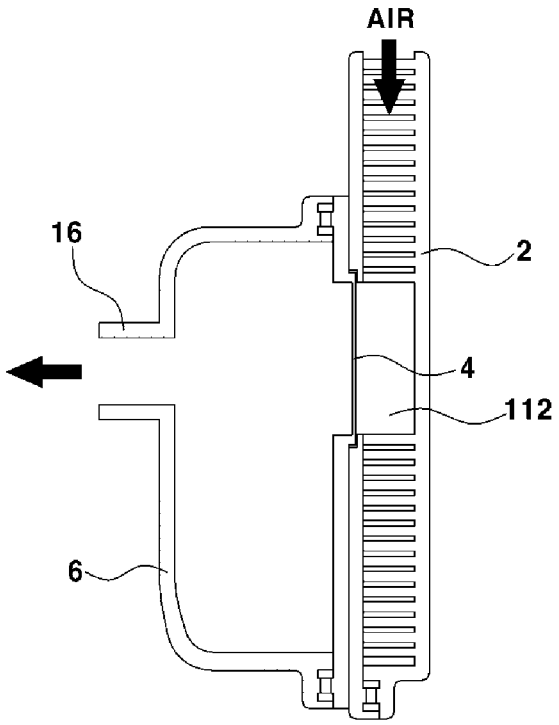
FIG. 8 is a cross-sectional view of FIG. 7B, taken along line B-B'.

FIG. 7A and FIG. 7B illustrates a state in which the apparatus 1 for amplifying sound waves according to various exemplary embodiments of the present invention is mounted on an intake system. FIG. 8 is a cross-sectional view of FIG. 7B, taken along line B-B'. Referring to FIG. 8, the apparatus 1 for amplifying sound waves according to various exemplary embodiments of the present invention amplifies sound waves that moves into the metamaterial structure 2 using an engine sound in the intake system. The sound waves amplified passing through the section 112 via the metamaterial M are directed to the resonance member 6 through the membrane member 4. That is, the membrane member 4 is provided on a portion of one side of the metamaterial structure 2 to give out the sound waves amplified by the metamaterial structure 2 to the outside. The resonance member 6 is mounted to surround the membrane member 4. The resonance member 6 discharges amplified sound through the discharge port 16 to the outside after amplifying the acoustic pressure inside the resonance member 6 through a resonance phenomenon. The apparatus 1 for amplifying sound waves according to various exemplary embodiments of the present invention can reduce costs compared to the above-described existing art. A plastic injection molding method may be applied to generate the apparatus 1 for amplifying sound waves according to various exemplary embodiments of the present invention and the apparatus 1 for amplifying sound waves obviates component incurring high costs, such as a motor, a controller, etc., and may thus achieve cost reduction.

Furthermore, the apparatus 1 for amplifying sound waves according to various exemplary embodiments of the present invention is much simplified as having reduced number of portions compared to related art.

Furthermore, the apparatus 1 for amplifying sound waves according to various exemplary embodiments of the present invention is a non-control system, requiring no power in operation compared to conventional art.

Figure 9:
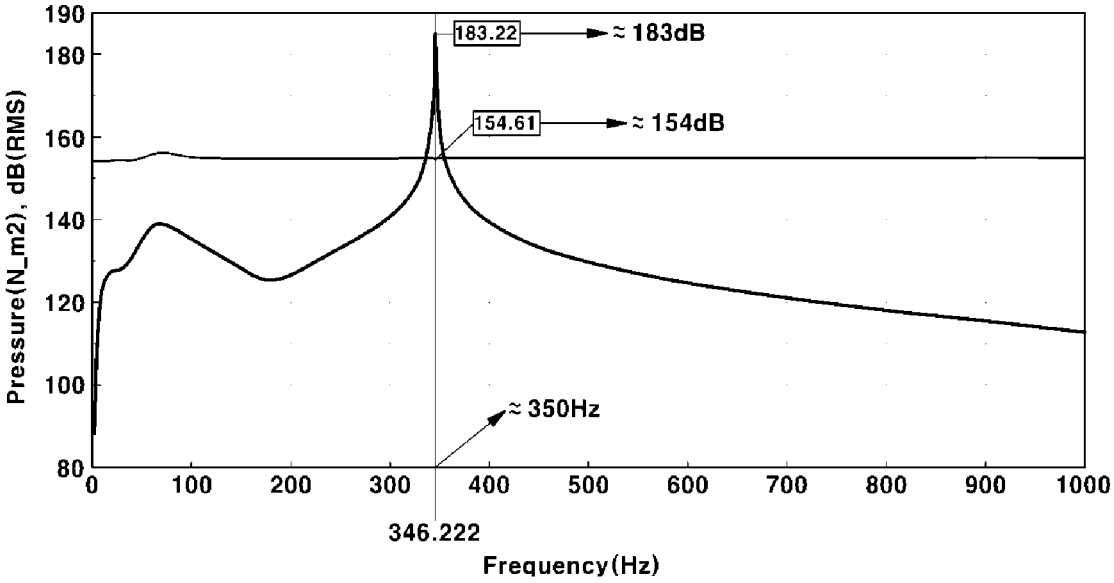
FIG. 9 and FIG. 10 are graphs representing an amplification effect of an apparatus of amplifying sound waves according to various exemplary embodiments of the present invention.
Figure 10:
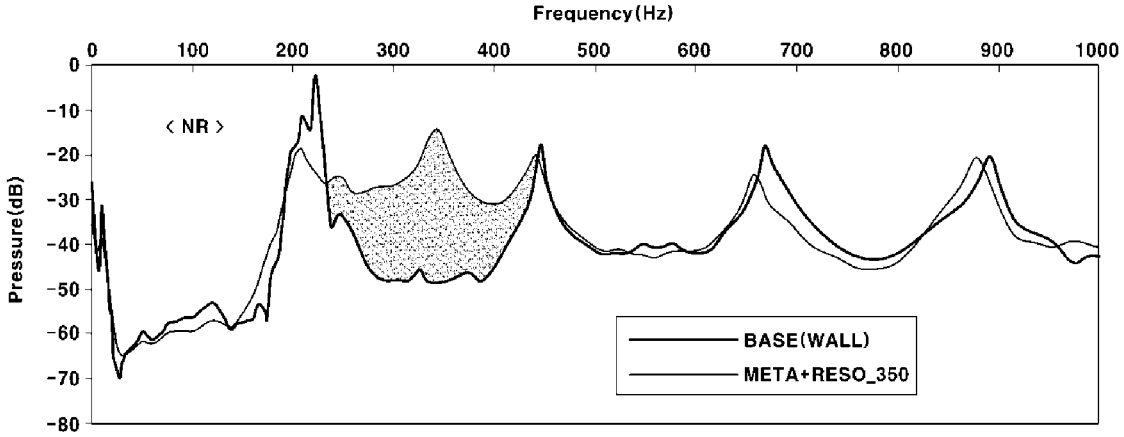

The apparatus 1 for amplifying sound waves according to various exemplary embodiments of the present invention are directed to providing excellent sound amplification performance. As illustrated in FIG. 9 and FIG. 10, a sound pressure of approximately 30 dB was shown to be amplified at a target frequency of 350 Hz and approximately 30 dB was amplified compared to a reference. The reference indicated as BASE (WALL) in FIG. 10 represents the acoustic pressure with respect to change in frequency, measured by a microphone mounted on an external wall of a circular pipe. META+RESO_350 in FIG. 10 indicates the apparatus 1 for amplifying sound waves according to various exemplary embodiments of the present invention and represents the acoustic pressure with respect to change in frequency measured in the apparatus 1 for amplifying sound waves mounted on the perforated external wall of the circular pipe.

As is apparent from the above description, an apparatus of amplifying sound waves according to various exemplary embodiments of the present invention can satisfy both the conventional engine sound and environmental friendliness.

Furthermore, the apparatus of amplifying sound waves according to various exemplary embodiments of the present invention can amplify an actual engine sound without applying separate power.

Furthermore, the apparatus of amplifying sound waves according to various exemplary embodiments of the present invention are directed to providing an actual engine sound even in a vehicle to which a turbocharger is applied.

Moreover, the apparatus of amplifying sound waves according to various exemplary embodiments of the present invention can reduce overall costs and reduce the number of parts.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An apparatus of amplifying sound waves, the apparatus comprising:

a metamaterial structure including a metamaterial inside thereof, an inlet through which air flows into the metamaterial structure, and a penetration portion formed to penetrate a portion of the metamaterial structure;

a membrane member coupled to the penetration portion; and a resonance member surrounding the membrane member and coupled to the metamaterial structure, wherein the resonance member includes an internal space inside thereof and a discharge port fluidically communicating with an outside of the resonance member and the internal space.

2. The apparatus of claim 1, further including a hermetic seal maintaining airtightness of a circumference of the membrane member.

3. The apparatus of claim 1, wherein the metamaterial includes a plurality of passages repeatedly formed, and wherein the plurality of passages is in fluidic communication with the inlet and the membrane member.

4. The apparatus of claim 3, wherein each of the plurality of passages is zig-zag shaped.

5. The apparatus of claim 3, wherein the plurality of passages includes:

a first flow path extending in a direction aligned with an inflow direction of air;

a second flow path extending from an end of the first flow path leftward or rightward with respect to the first flow path;

a third flow path being in fluidic communication with the second flow path, extending from an end of the second flow path in an extending direction of the first flow path, and being parallel to the first flow path; and a fourth flow path being in fluidic communication with the third flow path, extending from an end of the third flow path toward the extending direction of the first flow path, and being parallel to the second flow path.

6. The apparatus of claim 1, wherein a section of hollow space is provided inside the metamaterial structure, and the penetration portion contacts with the section.

7. The apparatus of claim 6, wherein the metamaterial includes a plurality of passages repeatedly formed, and wherein the air flowing into the metamaterial structure through the inlet sequentially passes through the plurality of passages and the section and flows into the internal space of the resonance member via the membrane member.

8. The apparatus of claim 7, wherein the plurality of passages includes:

a first flow path extending in a direction aligned with an inflow direction of air;

a second flow path extending from an end of the first flow path leftward or rightward with respect to the first flow path;

a third flow path being in fluidic communication with the second flow path, extending from an end of the second flow path in an extending direction of the first flow path, and being parallel to the first flow path; and a fourth flow path being in fluidic communication with the third flow path, extending from an end of the third flow path toward the extending direction of the first flow path, and being parallel to the second flow path.

9. The apparatus of claim 1, wherein the metamaterial structure further includes:

a first housing receiving the metamaterial inside thereof; and a second housing airtightly coupled to the first housing and provided with the penetration portion.

10. The apparatus of claim 9, wherein the first housing includes a partition member protruding from a portion of a circumference of the first housing, and the second housing includes a protrusion protruding from a side of the second housing and coupled to the partition member, and wherein the inlet is defined by a space generated by coupling the partition member and the protrusion to each other.

11. The apparatus of claim 10, wherein a sealing member is mounted around a circumference of the inlet to ensure airtightness.

12. The apparatus of claim 9, further including:

a plurality of through-holes piercing the first housing and the second housing; and fastening members fixedly inserted into the plurality of through holes.

13. The apparatus of claim 9, wherein an insert is formed to protrude from a surface of the second housing and spaced from a circumference of the penetration portion with a predetermined distance; and wherein the resonance member is coupled to the insert.

14. The apparatus of claim 9, wherein the membrane member includes a guide protrusion and a coupling groove, and wherein the guide protrusion of the membrane member is configured to be accommodated in a guide groove of the second housing, and the coupling groove of the membrane member is configured to be engaged with a coupling protrusion of the second housing.

15. The apparatus of claim 1, wherein the membrane member includes a guide protrusion and a coupling groove, and wherein the guide protrusion of the membrane member is configured to be accommodated in a guide groove of the metamaterial structure, and the coupling groove of the membrane member is configured to be engaged with a coupling protrusion of the metamaterial structure.

* * * * *